US006206650B1

(12) United States Patent
Thurner

(10) Patent No.: US 6,206,650 B1
(45) Date of Patent: Mar. 27, 2001

(54) VARIABLE AXIAL PISTON DISPLACEMENT MACHINE WITH MAXIMIZED SWIVEL ANGLE

(75) Inventor: Jörg Thurner, Vienna (AT)

(73) Assignee: TCG Unitech Aktiengesellschaft, Kirchdorf/Krems (AU)

( * ) Notice: Subject to any disclaimer, the term of this patent is extended or adjusted under 35 U.S.C. 154(b) by 0 days.

(21) Appl. No.: 09/299,736

(22) Filed: Apr. 27, 1999

(30) Foreign Application Priority Data

Apr. 27, 1998 (AT) ..... 697/98

(51) Int. Cl.[7] ..... F04B 1/12; F01B 3/00

(52) U.S. Cl. ..... 417/269; 92/71; 92/12.2; 91/506

(58) Field of Search ..... 417/269; 92/71, 92/12.2; 91/506

(56) References Cited

U.S. PATENT DOCUMENTS

| | | | | |
|---|---|---|---|---|
| 765,434 | | 7/1904 | Manly | 91/503 |
| 1,052,569 | * | 2/1913 | Cherry | 417/269 |
| 1,117,461 | * | 11/1914 | Strite | 92/57 |
| 1,659,238 | * | 4/1928 | Boyce | 74/60 |
| 3,056,387 | * | 1/1962 | Budzich | 121/119 |
| 3,075,472 | * | 1/1963 | Garnier | 103/162 |
| 3,292,554 | * | 12/1966 | Hessler | 103/173 |
| 3,296,976 | * | 1/1967 | Soeters | 103/173 |
| 3,442,181 | * | 5/1969 | Olderaan | 92/57 |
| 4,782,712 | * | 11/1988 | Takahashi et al. | 74/60 |
| 5,038,634 | * | 8/1991 | Matsuto et al. | 74/730 |
| 5,094,147 | * | 3/1992 | Shaw | 91/499 |
| 5,176,066 | * | 1/1993 | Kanamaru et al. | 91/499 |
| 5,304,043 | * | 4/1994 | Shilling | 417/269 |

FOREIGN PATENT DOCUMENTS

| | | | |
|---|---|---|---|
| 1106486 | * | 3/1968 | (GB) . |
| 8600376 | | 1/1986 | (WO) . |
| 9602735 | | 2/1996 | (WO) . |

* cited by examiner

*Primary Examiner*—Timothy S. Thorpe
*Assistant Examiner*—Timothy P. Solak
(74) *Attorney, Agent, or Firm*—Dykema Gossett PLLC

(57) ABSTRACT

An axial piston displacement machine for converting hydraulic work into mechanical work or vice-versa with a plurality of hydraulic cylinders which are rotatably arranged with substantially parallel axes about a joint longitudinal axis, including pistons which are movably arranged in the cylinders and which are in connection with a swivellable plate an adjusting device for setting the swiveling angle of the plate a sleeve which rotates with the cylinders and is arranged outside of the plate, and engagement means for transmitting a torque between the plate and the sleeve on the plate and on the sleeve. An increased efficiency is achieved by including a toothed wheel attached on the outer circumference of the sleeve in order to tap a torque from the sleeve or to introduce a torque to the sleeve.

11 Claims, 4 Drawing Sheets

VARIABLE AXIAL PISTON DISPLACEMENT MACHINE WITH MAXIMIZED SWIVEL ANGLE

BACKGROUND OF THE INVENTION

1. Field of the Invention

The invention relates to an axial piston displacement machine for converting hydraulic work into mechanical work or vice-versa having a plurality of hydraulic cylinders which are positioned about a joint longitudinal rotation axis and which define parallel axes, pistons being movably arranged in the cylinders and connected with a swivellable plate, an adjusting device for setting the swiveling angle of the plate, a sleeve which is non-turnable with respect to the cylinders arranged outside of the plate, and engagement means for transmitting a torque between the plate and the sleeve arranged on the plate and on the sleeve.

2. The Prior Art

Axial piston displacement machines of the aforementioned kind are capable of converting the energy of a pressurized hydraulic medium into mechanical work in the form of a rotational movement. Motors of this kind are used for various machines such as forklifts or backhoes. In the opposite case, such a machine will also allow pumping operation by pressurizing a hydraulic medium through the drive of the machine.

Machines of the aforementioned kind are referred to in practice as swash plate machines. A relevant feature of swash plate design is that the pistons rotate about a common longitudinal axis with the driven speed. The reciprocating movement of the cylinders which are arranged in this piston is achieved in such a way that the p-stons rest on a swivellable plate. The stroke of the piston depends on the angle about which the plate is swiveled. In this way it is possible to provide a very simple control of the output and speed of such a machine.

From WO 86/00376, an axial piston displacement motor is known which is arranged in the above-described manner. Slide blocks are attached in an articulated manner on the faces of the individual pistons which are hydrostatically held on a swivellable, but non-rotating plate. During the working stroke a lateral force is exerted on each piston by inclining the plate, which force exercises a torque on the common cylinder body in which all pistons are arranged. In this way the cylinder body is made to rotate. The respective torque can be tapped through a shaft on which the cylinder body is wedged up, with the shaft extending through the swash plate.

Such a known apparatus has a number of disadvantages. Firstly, the swiveling angle of the swash plate is limited to a maximum value of approx. 18° for constructional reasons. On the one hand, this is due to the fact that the space must be kept free for the penetrating driven shaft. On the other hand, lateral forces, which during the working strokes of the pistons are exerted on the same, cause moments of tilt which strongly stress the piston guides. It is obvious that these moments of tilt will rise strongly with increasing angle of inclination of the swash plate. This also limits the angle of inclination. On the other hand, the efficiency of such a machine strongly depends on the angle of inclination of the swash plate. One can observe a strong decrease in the efficiency at smaller angles. At an angle of 4° or less, self-Locking can occur, i.e. the efficiency is zero in motor operation.

U.S. Pat. No. 765,434 discloses an axial piston displacement machine which is provided with rotatable hydraulic cylinders whose pistons are in connection with a swivellable plate. The swiveling angle of the plate can be set through an adjusting device. The transmission of the torque from the swivellable plate to the piston unit occurs through a toothing which is arranged on the circumference of the piston unit and in the form of conical rods projecting forwardly in the axial direction. The cylinder unit is held on a shaft and is rigidly connected with this shaft which extends through the plate. The torque is introduced through this shaft during pumping operation and is tapped through this shaft during motor operation. For this reason the permitted swiveling range of the plate is Limited. Moreover, the diameter of the cylinder unit must not be below a certain minimum value.

WO 96/02735 shows a similar solution in which the drive and driven shaft penetrates the plate. In this case too the swiveling angle of the plate is limited for space reasons. In the solution as described in GB 1 106 486 A, the swiveling angle of the plate cannot be operatively changed. Merely a minor adjusting possibility has been provided for. In this solution the central shaft also penetrates the plate.

The above-described known solutions have in common that the torque which is to be introduced into the plate during pumping operation or which is to be tapped from the plate during motor operation is conducted outwardly through a central shaft. The central shaft is either connected with the plate per se through a kind of cardanic mounting or the torque is guided through the cylinder unit which is in non-positive connection by way of an outer sleeve or the like. Both solutions have in common that the centrally arranged shaft limits the swiveling angle of the plate.

SUMMARY OF THE INVENTION

It is the object of the present invention to further improve an axial piston displacement machine of the kind mentioned above in such a way that the aforementioned disadvantages can be avoided and that a large displacement range at high efficiency is enabled. This is to be achieved in the most compact dimensions possible and with low stress to the respective components.

These objects are achieved in accordance with the invention in such a way that a toothed wheel is attached to the outer circumference of the sleeve in order to tap a torque from the sleeve or to introduce the same into it. The relevant aspect of the present invention As that the torque is not tapped from the cylinders, but from the swash plate per se. As it is not necessary to guide any shaft whatsoever through the swash plate, very large swiveling angles can be achieved. The load on the piston-cylinder pairing occurs in accordance with the invention substantially in the axial direction, so that these components can be produced with a small size, at low cost and with a long service life. The relevant aspect for the invention is not that the sleeve is arranged as a component which enclosed the plate in form of an envelope, but that the torque transmission from the plate occurs through an exterior component. As a result of the fact that the further discharge of the torque or the introduction of the torque occurs through a toothed wheel which is arranged on the outside on the outer component, i.e. the sleeve, the designer is provided with much freedom in the arrangement of the components in the interior, i.e. the cylinder, the plate and the swiveling apparatus. This will have a particular effect in the operation of the motor, since the efficiency of transmission will rise with the increasing swiveling angle. The relevant aspect in connection with the large swiveling angle is that the plate is not penetrated by a shaft transmitting the torque and that the torque is not transmitted through a piston, but instead through a component arranged on the outside of the plate.

A particular advantage of the invention is that the cylinder drum in which the individual cylinders are arranged need not be absolutely rigidly connected with the parts that transmit the torque. An this way it is possible to ideally arrange the hydrostatic support of the cylinder drum on a sealing surface at which it comes into contact with a plate cam. Leakage losses can thus be minimized.

It is particularly preferable if the engagement means are arranged as rolls which are arranged on the outer circumference of the plate and engage into respective grooves of the sleeve. The arrangement with rolls at an angle of 90° each which are arranged on the circumference of the plate has proved to be particularly advantageous. In such an embodiment it is sufficient when it is ensured that at least two rolls are in engagement with the respective grooves.

Principally, the pistons can be arranged in the cylinders in such a way that they are only movable in the axial direction. In such a case, sliding blocks or other means would have to be provided on the plate in order to allow a certain relative movement between the piston and the plate in the radial direction of the plate. In contrast to this it is particularly preferable if the pistons are articulated with ball-and-socket joints on the plate and are slightly swivellable with respect to the cylinders. In this case the pistons are only loaded in the axial direction. In this way it is also possible to omit the hydrostatical bearing of the sliding blocks as would be required according to the state of the art. This entails a considerable improvement of the efficiency since respective losses of oil can be avoided in this way.

In a further particularly preferred embodiment of the present invention it is provided that a swiveling actuating body is attached on the plate by way of at least one roller bearing, which body is hold non-turnably with respect to the longitudinal axis and upon which the displacement device acts.

In this respect it is favorable if a toothed wheel segment is provided on the swiveling actuating body which is in engagement with a further toothed wheel segment which can be actuated through hydraulic pistons. A rapid and reliable adjustment of the swiveling angle can be realized in this manner with a low constructional effort.

It has proven to be particularly favorable if the maximum swiveling angle of the plate is fixed at a value of between 35 and 42°, preferably approx. 40°. At larger swiveling angles there will be certain constructional difficulties. Thus, different components will be strongly weakened by the required recesses and releases, which has a negative effect on the service life and the endurance of the apparatus.

In a number of applications it is desirable to be able to operate a machine of the aforementioned kind both as a motor and as a pump. In conventional machines it is necessary for this purpose to completely change over the control of the oil supply in order to allow the changeover of the operating mode. If the plate is swivellable from the zero position in both directions, such a changeover can occur without having to change the control on the hydraulic side.

During the operation of the apparatus in accordance with the invention, the cylinders are pressed against the plate cam by the working pressure of the hydraulic oil. In order to ensure a secure contact on the plate cam even in the range of no-load operation, it is favorable if the hydraulic cylinders are arranged in a common cylinder body which rests on a fixed plate cam which controls the oil supply and discharge of the cylinders and that preferably springs are provided in order to pre-tension the cylinder body against the plate cam.

It is particularly preferable if the plate can be provided with a closed arrangement in its middle region. In this way it is possible to achieve a mechanically particularly sturdy arrangement.

BRIEF DESCRIPTION OF THE DRAWINGS

The invention will now be explained below in closer detail by reference to the embodiments shown in the drawings, in which.

DETAILED DESCRIPTION OF THE PREFERRED EMBODIMENTS

Figure 1:
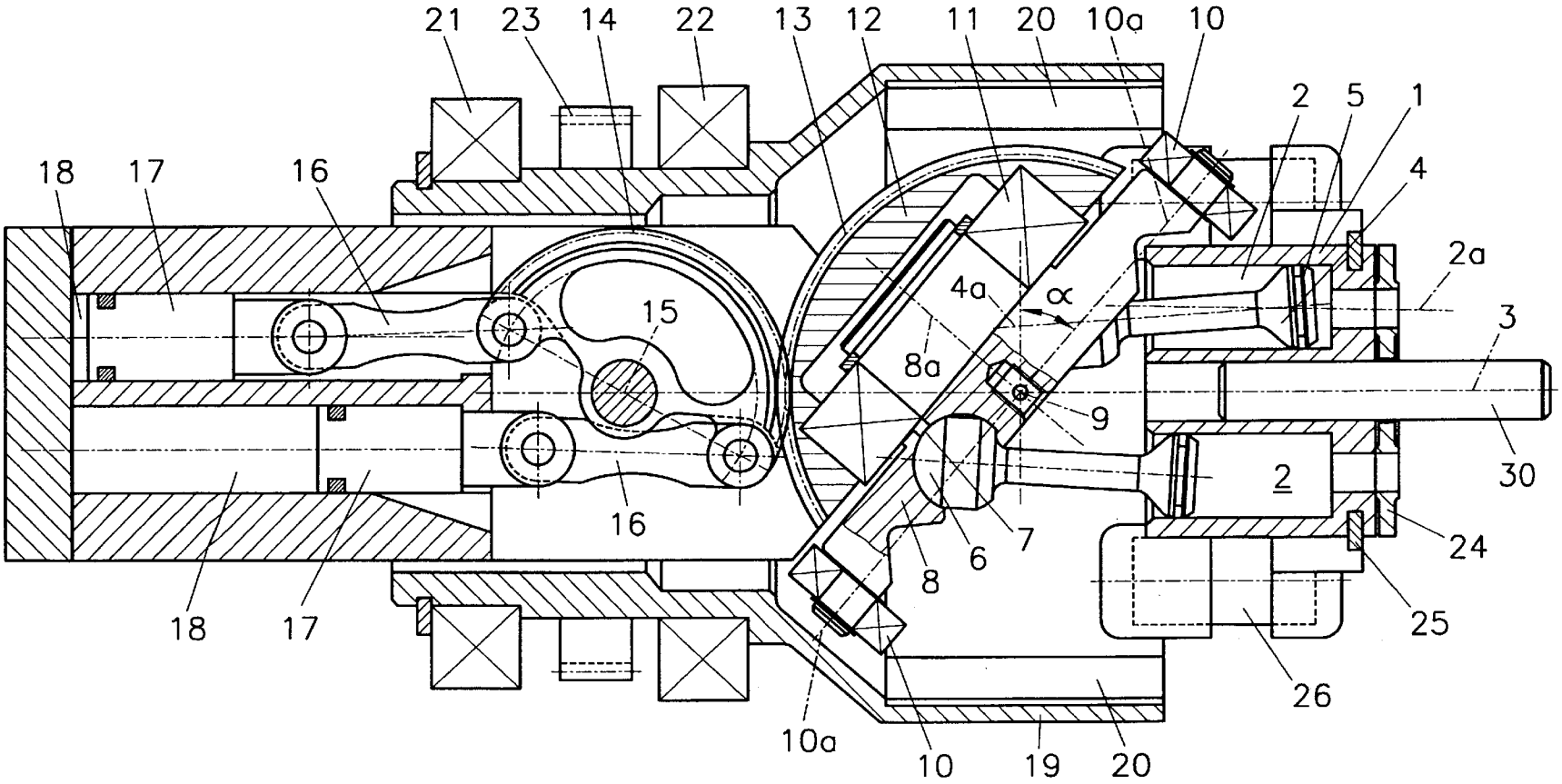
FIGS. 1 and 2 show longitudinal sections of an apparatus in accordance with the invention in the fully swiveled state according to lines I—I and II—II in FIG. 3.

FIG. 1 shows a longitudinal section through an axial piston displacement machine in accordance with the invention. A plurality of cylinders 2 are arranged in a cylinder drum 1 and define axes 2*a* which are parallel to one another and parallel to a common longitudinal axis 3. A piston 4 is movably arranged in the axial direction in each cylinder 2. A slight swiveling of the piston axis 4*a* towards the cylinder axis 2*a* is permitted by a respective arrangement of the piston 4 with extremely short sealing surfaces 5. At their ends which are remote from cylinders 2, the pistons 4 each include a ball-and-socket joint 6 which is held in a respective recess 7 of a plate 8. Plate 8 is swivellable both about an axis 3 as well as about spatially fixed axis 9 which intersects the longitudinal axis 3. In total, the plate 8 rotates about its own axis 8*a* with respect to the spatially fixed coordinate system at a constant swiveling angle a. Four rolls 10 are arranged on the circumference of plate 8 at angular intervals of 90° each. Their axes of rotation 10*a* lie within the plane of the plate and they penetrate the point of intersection of longitudinal axis 3 with the axis 9. A swiveling actuating body 12 is attached to the plate 8 by means of rolling bearing 11, which body is jointly swivellable with plate 8 about axis 9 which is not swivellable about axis 3. The swiveling actuating body 12 includes a toothed wheel segment 13 on its outer circumference which is in engagement with a further toothed wheel segment 14. The further toothed wheel segment 14 is swivellably arranged through a stationary axis 15 and is in connection with piston valves 17 by means of two connecting members 16 which are arranged in respective control cylinders 18 in order to control the swiveling movement of the plate 8. All the latter mentioned components are substantially stationary, i.e., they are not arranged rotatably about the longitudinal axis 3.

Figure 2:
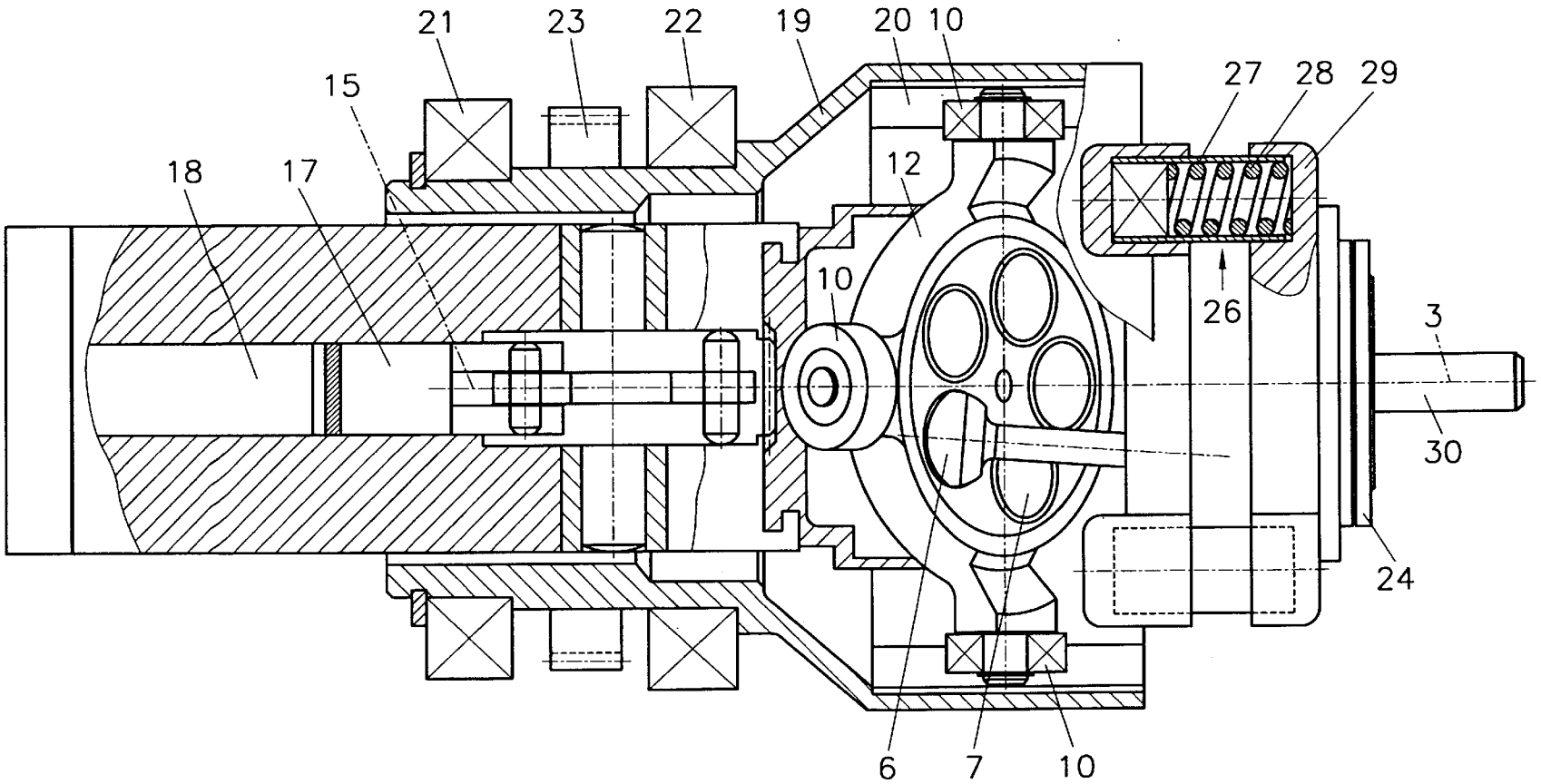
Figure 3:
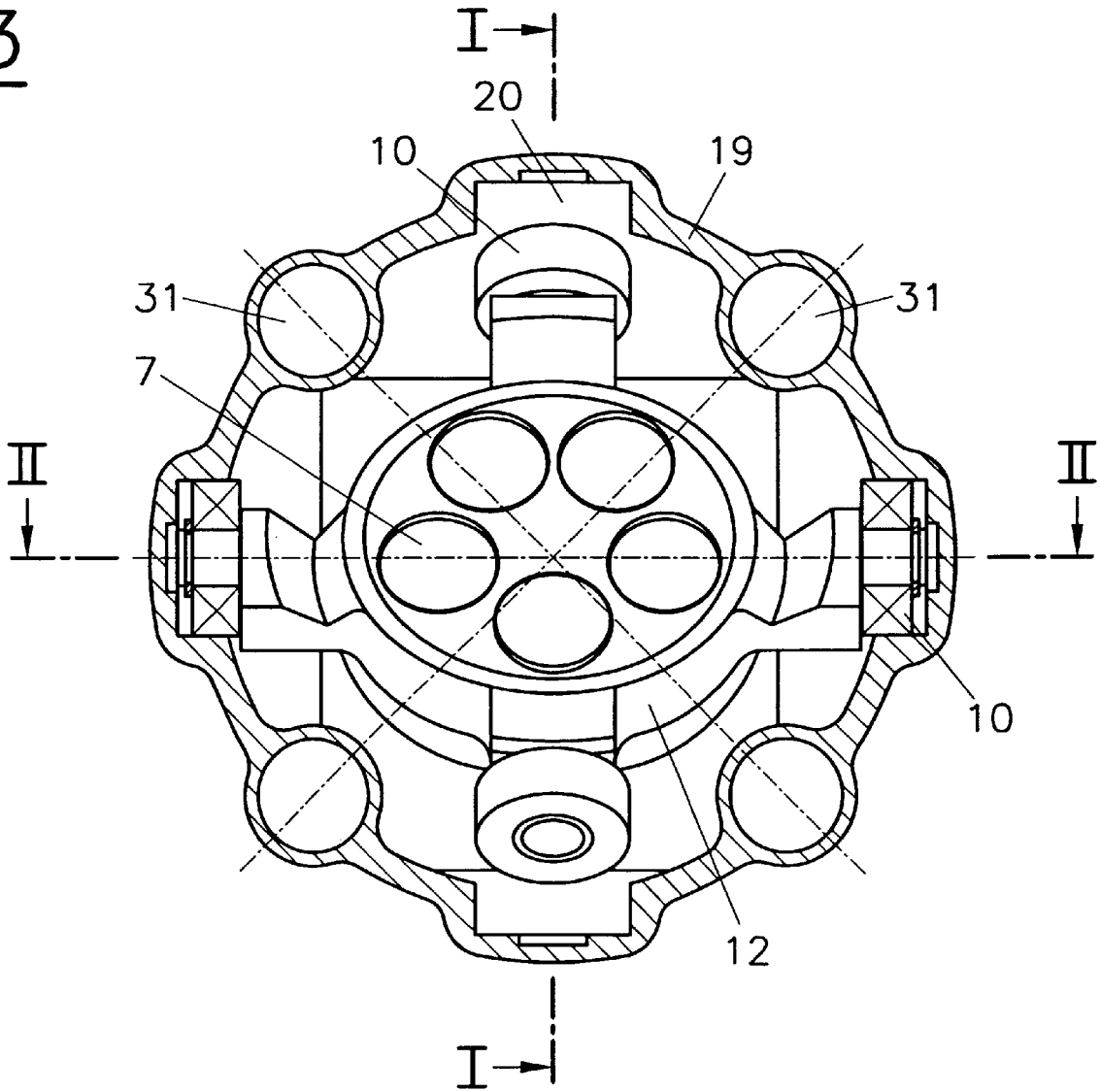
FIG. 3 shows a view of the apparatus of FIGS. 1 and 2 with a removed cylinder drum.

A sleeve 19 is provided radially outside of plate 8, which sleeve is provided with four grooves 20 on its inner circumference which are arranged parallel to the longitudinal axis 3. The rolls 10 of the plate 8 are in connection with the grooves 20 at least during a part of the rotational movement of plate 8 and sleeve 19. In the state as represented in FIGS. 1 through 3 in which the plate 8 is swiveled out as far as possible, two of the rolls 10 can exit from the grooves 20. In this case the transmission of the torque from the plate 8 to sleeve 19 will occur through the two other rolls 10. This engagement ensures that the sleeve 19 rotates with the angular speed about the longitudinal axis 3 which corresponds to the angular speed component of plate 8 in the direction of longitudinal axis 3. Sleeve 19 is held on a housing (not shown in closer detail) by means of roller bearings 21 and 22. The torque induced during the operation of the motor in sleeve 19 is tapped by way of a toothed wheel 23 which is also provided on the outer circumference of sleeve 19.

The maximum displacement angle a of the illustrated embodiment is 40°. In this way it is possible to achieve a very large displacement range and a favorable efficiency. A further improvement of the efficiency can be achieved in that a substantially loss-free displacement of the plate 8 can be achieved through the roller bearings 11. A hydrostatic bearing is required in the machine in accordance with the invention only in the zone of the plate cam 24, which is arranged in the known manner in order to control the oil supply to the individual cylinders 2 and the oil discharge from the individual cylinders 2. Pressure elements 26, which are held on sleeve 19, rest on cylinder drum 1 through a ring 25. As is shown in FIG. 2 in detail, the pressure elements 26 consist of a cylindrical sleeve 27 which are provided for transmitting the torque between sleeve 19 and the cylinder drum 1 and of a pressure spring 28 arranged in sleeve 27. A disc 29 absorbs the spring forces of the pressure springs 28 and transmits the same through ring 25 onto the cylinder drum 1. It is achieved in this manner that even during run-up, i.e., when the oil pressure has not yet built up in the cylinders 2, the required pressing pressure between cylinder drum 1 and plate cam 24 is available. An axis 30 is used for centering the cylinder drum 1 and the plate cam 24.

A particular advantage of the resilient suspension of the cylinder drum 1 is that the hydrostatic bearing of cylinder drum 1 can be arranged optimally with respect to plate cam 24. It is obvious that the cylinder drum 1 is more strongly pressed against plate cam 24 on the side of the respective cylinders performing the working cycle than on the opposite side. The resilient suspension allows a slight inclination of the cylinder drum 1. The thus caused wedge-shaped oil film on the sealing surface 5 stabilizes the bearing of the cylinder drum 1. In this way it is possible to ensure minimal leakage losses.

Recesses 31 are shown in FIG. 3 into which the sleeves 27 are introduced.

Figure 4:
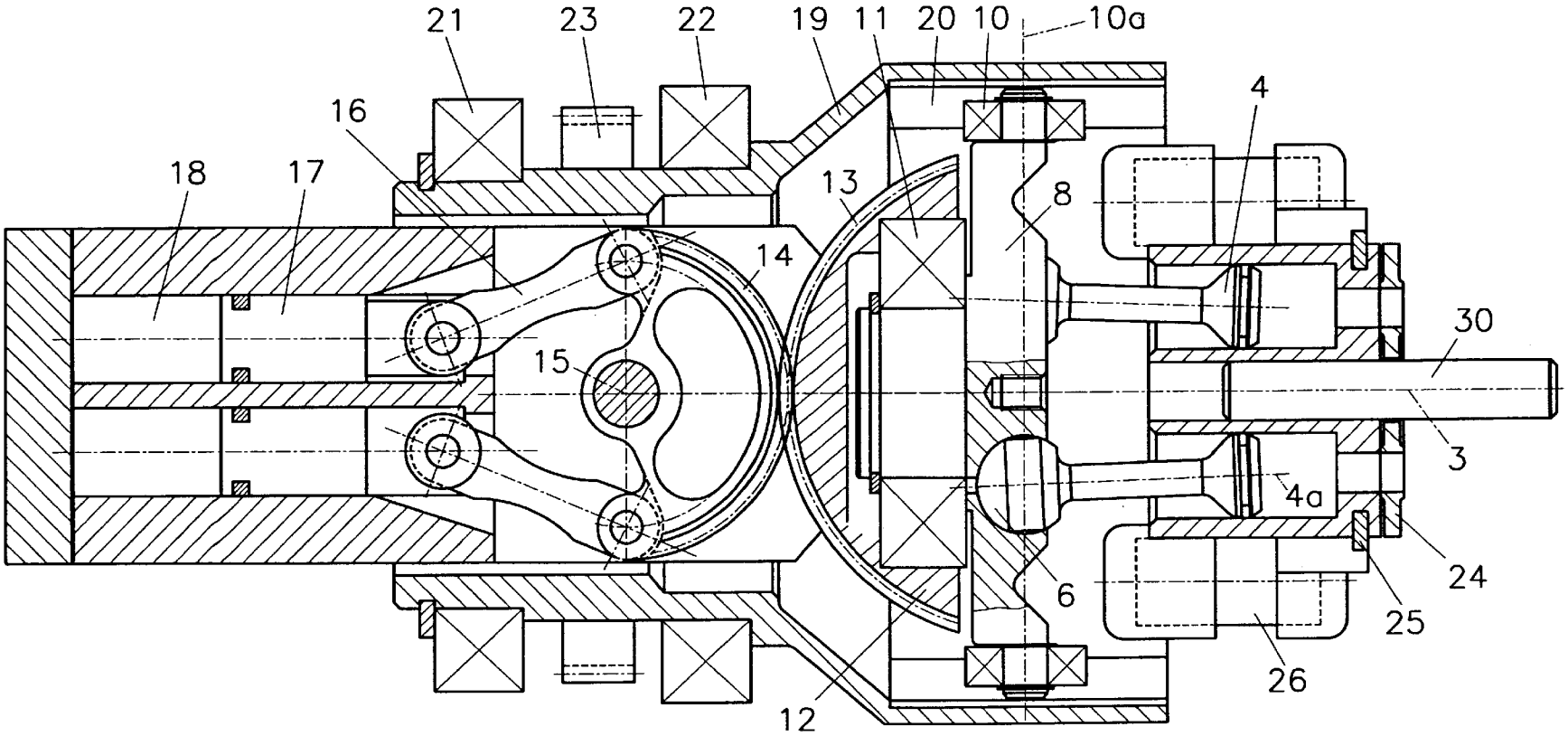
FIG. 4 shows the embodiment of FIGS. 1 through 3 in the zero position.

FIG. 4 shows the embodiment of FIGS. 1 to 3 in a representation corresponding to FIG. 1, but with the plate 8 being in the zero position, however. In this position the oil pressure in the cylinders 2 is unable to produce any torque on sleeve 19. If the plate 8 is further swiveled from the position in FIG. 4 in order to reach a position which is opposite to that of FIG. 1, the apparatus in accordance with the invention is switched over from motor operation to pumping operation. In this way it is possible, without any complex hydraulic or mechanical circuitry, to reclaim energy during the braking operation of a vehicle.

As a result of the large swiveling angle, it is possible to achieve a very high power density with the apparatus in accordance with the invention. This relates both to the volume, i.e., the extremely compact arrangement of the apparatus, as well as to the favorable weight coefficient. A favorable efficiency and a finely tuned ability to the control the apparatus are given by the large swiveling angle. The apparatus in accordance with the invention is particularly suitable for applications in vehicles where special emphasis is placed on compact size and low weight.

I claim:

1. An axial piston displacement machine for converting hydraulic work into mechanical work or vice-versa including a plurality of hydraulic cylinders which are rotatably arranged with substantially parallel axes about joint longitudinal axis, pistons which are movably arranged in the cylinders, a swivellable plate to which said pistons are connected, an adjusting device for adjusting the swiveling angle of the plate, a sleeve which is positioned outside of the plate, and engagement means for transmitting a torque between the plate and the sleeve located on the plate and on the sleeve, and a toothed wheel attached on an outer circumference of the sleeve for tapping a torque from the sleeve or to introduce a torque to the sleeve.

2. An axial piston displacement machine according to claim 1, wherein the engagement means are rolls which are arranged on an outer circumference of the plate and engage into respective grooves of the sleeve.

3. An axial piston displacement machine according to claim 2, wherein four rolls are provided on the plate at an angular distance of 90°.

4. An axial piston displacement machine according to claim 1, wherein the pistons are articulated on the plate with ball-and-socket joints and are swivellable with respect to the cylinders.

5. An axial piston displacement machine according to claim 1, wherein a swiveling actuating body is attached to the plate by means of at least one roller bearing, said adjusting device being connected to said swiveling actuating body.

6. An axial piston displacement machine according to claim 1, wherein the swiveling actuating body includes a first toothed wheel segment, and wherein said adjusting device includes hydraulic pistons connected to a second toothed wheel segment which engages said first toothed wheel segment.

7. An axial piston displacement machine according to claim 1, wherein the plate can swivel to a maximum angle of 35 to 42°.

8. An axial piston displacement machine according to claim 1, wherein the plate is swivellable from a zero position in opposite directions.

9. An axial piston displacement machine according to claim 1, wherein the hydraulic cylinders are arranged in a common cylinder body which rests on a fixed plate cam which controls the oil supply and discharge of the cylinders and springs are provided in order to pretension the cylinder body against the plate cam.

10. An axial piston displacement machine according to claim 9, wherein the cylinder body is fastened to the sleeve.

11. An axial piston displacement machine according to claim 1, wherein the plate is provided with a closed arrangement in its middle region.

* * * * *

UNITED STATES PATENT AND TRADEMARK OFFICE

CERTIFICATE OF CORRECTION

PATENT NO. : 6,206,650 B1
DATED : March 27, 2001
INVENTOR(S) : Jörg Thurner

It is certified that error appears in the above-identified patent and that said Letters Patent is hereby corrected as shown below:

Title page,
Item [73], Assignee, TCG Unitech Aktiengesellschaft,
Kirchdorf/Krems (AT)

Signed and Sealed this

Eighteenth Day of December, 2001

*Attest:*

*Attesting Officer*

JAMES E. ROGAN
*Director of the United States Patent and Trademark Office*